US009580199B2

(12) United States Patent
Gorbi et al.

(10) Patent No.: US 9,580,199 B2
(45) Date of Patent: Feb. 28, 2017

(54) CONTAINER PROCESSING MACHINE

(75) Inventors: Alessandro Gorbi, Parma (IT); Luca Venturini, Parma (IT); James Carmichael, Parma (IT)

(73) Assignee: SIDEL S.p.A. con Socio Unico, Parma (IT)

( * ) Notice: Subject to any disclaimer, the term of this patent is extended or adjusted under 35 U.S.C. 154(b) by 1067 days.

(21) Appl. No.: 13/812,769

(22) PCT Filed: Jul. 30, 2010

(86) PCT No.: PCT/IT2010/000346

§ 371 (c)(1),
(2), (4) Date: Apr. 8, 2013

(87) PCT Pub. No.: WO2012/014237

PCT Pub. Date: Feb. 2, 2012

(65) Prior Publication Data

US 2013/0192700 A1 Aug. 1, 2013

(51) Int. Cl.
*B25B 11/00* (2006.01)
*B65C 9/08* (2006.01)
(Continued)

(52) U.S. Cl.
CPC ..... *B65C 9/08* (2013.01); *B65C 9/188* (2013.01); *B65C 9/1815* (2013.01);
(Continued)

(58) Field of Classification Search
CPC ..... B25B 11/00; B25B 11/002
See application file for complete search history.

(56) References Cited

U.S. PATENT DOCUMENTS 5,586,159 A * 12/1996 Kitaoka ..... G03F 7/707 269/21
5,888,343 A 3/1999 Olson
(Continued)

FOREIGN PATENT DOCUMENTS

DE 19533775 A1 3/1997
GB 2188608 A 10/1987
NO WO-2005/005261 A1 1/2005

OTHER PUBLICATIONS

"International Application Serial No. PCT/IT2010/000346, International Search Report mailed May 10, 2011", 4 pgs.
(Continued)

*Primary Examiner* — Lee D Wilson
(74) *Attorney, Agent, or Firm* — Schwegman Lundberg & Woessner, P.A.

(57) ABSTRACT

There is disclosed a container processing machine comprising a material handling surface for handling a sheet-like material through suction and a vacuum source in fluid connection with said material handling surface, the machine including means for detecting and transmitting a value of pressure of the gas being suctioned; a controllably operable flow valve; a control unit operatively connected with said detection and transmission means and with said flow valve; said detection and transmission means and said flow valve being arranged between said vacuum source and said material handling surface; said control unit being programmed to adjust the degree of opening of said flow valve in response to a signal which is a function of at least said value of pressure.

19 Claims, 1 Drawing Sheet

(51) Int. Cl.
*B65C 9/18* (2006.01)
*B65C 9/40* (2006.01)

(52) U.S. Cl.
CPC ..... *B65C 9/1819* (2013.01); *B65C 9/1876* (2013.01); *B65C 9/40* (2013.01); *Y10T 137/85986* (2015.04)

(56) References Cited

U.S. PATENT DOCUMENTS

| | | | | |
|---|---|---|---|---|
| 6,182,956 | B1 * | 2/2001 | McMillan | B25B 11/005 269/21 |
| 6,546,958 | B1 | 4/2003 | Parker | |
| 2007/0222131 | A1 * | 9/2007 | Fukumoto | B25B 11/005 269/21 |
| 2010/0133735 | A1 * | 6/2010 | Katsuta | B23Q 3/088 269/21 |
| 2013/0192700 | A1 * | 8/2013 | Gorbi | B65C 9/1815 137/565.11 |

OTHER PUBLICATIONS

"International Application Serial No. PCT/IT2010/000346, Written Opinion mailed May 10, 2011", 5 pgs.

* cited by examiner

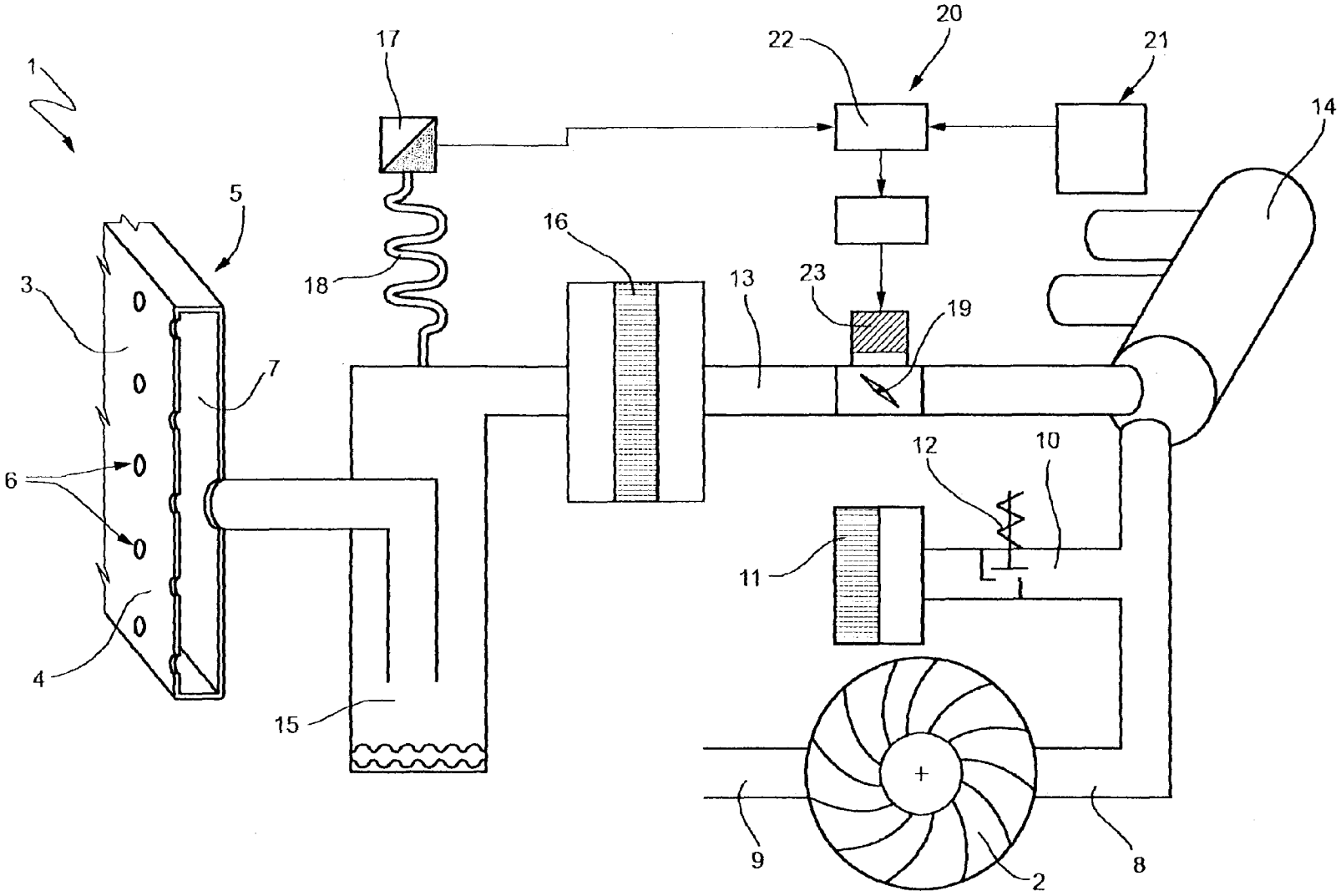
1
2
3
4
5
6
7
8
9
10
11
12
13
14
15
16
17
18
19
20
21
22
23

CONTAINER PROCESSING MACHINE

RELATED APPLICATIONS

This application is a U.S. National Stage Filing under 35 U.S.C. 371 from International Application No. PCT/IT2010/000346, filed on Jul. 30, 2010, and published as WO 2012/014237 A1 on Jul. 30, 2010; which application and publication are incorporated herein by reference in their entirety.

TECHNICAL FIELD

The present invention relates to a container processing machine.

More specifically, the present invention refers to a container processing machine wherein suction is used for handling a sheet-like material which has to be, e.g. transferred, applied to a surface of a container, etc., especially where said sheet-like material is particularly weak, e.g. due to a reduced thickness combined with poor elastic properties.

BACKGROUND ART

The use of container-processing machines, such as labelling machines for gluing and transferring labels onto the surface of containers, is very well known and widespread.

In these machines containers are typically carried by a carousel to come into contact with a labelling unit. The labelling unit comprises one or more so called "vacuum drums" by which a label material strip is received from a roll feeding system. The labelling system cuts the label off the label material strip at the appropriate length; glues the label by appropriate means (such as a gluing drum, spray and injector systems or the like); and finally transfers the glued label to a respective container. For performance of these operations, the label is, at different stages, retained on the outer surface of a vacuum drum by means of suction forces applied on the label. To this purpose, the surface of the vacuum drum comprises a plurality of orifices that are in fluid communication with a vacuum source.

On the one hand, the use of a thin film-like material as the label material entails a rather desirable reduction of production costs with respect to more conventional thicker alternatives. However, when a label material with reduced thickness and a low elastic modulus is used, a number of undesired issues are typically encountered, which are caused by an inherent weakness of such material.

It is a given fact that the labelling speed has become a key factor, especially in view of the high production requirements which are nowadays very common in canning and bottling plants. Speeds in excess of ten containers per second have regularly been achieved with certain labelling materials and label-handling processes.

However, while, in general, thicker materials with good elastic properties and low friction display a good resistance to stretching and are, consequently, relatively easy to handle at high said materials can withstand relatively great forces (i.e. a high degree of vacuum can be conveniently used for handling said materials throughout the process), when weaker label materials are run at high speeds and with high friction, a variety of undesirable events, such as splitting, stretching and misalignment of labels, often occur.

With roll-fed thin labels, when the labels are cut from the strip of labelling material, excessive tension on the label can cause the labels to split or tear instead of being cleanly cut.

Similarly, over-tensioning can cause thin labels to stretch as they are picked up by the vacuum drum. As the labels are transferred to a vacuum drum, excessive vacuum can cause the label segment to shift or snap, which is highly likely to cause a temporary crash of the machine, because the label shall get off its ideal path within the machine, glue may be spilled, and so forth. In other words, ripping of the label material typically results in an undesirable interruption of the overall labelling process.

Furthermore, some labelling materials may include coatings or have be subjected to other superficial treatments that result in higher coefficients of friction, which can also affect the labelling process. In particular, labels having a higher coefficient of friction tend to become over-tensioned more easily, which aggravates the problems associated with over-tensioning already described above.

Yet another problem encountered, when labels are supported by a vacuum drum during the labelling process, is that glue applicators for applying glue to the label segments can become jammed by labels, if insufficient vacuum is provided to prevent the labels from following the glue applicator.

As a result, a particularly thorough control of the operating conditions—mainly as concerns the degree of vacuum provided at the vacuum drum—is required in order for high speed labelling equipment to manage to effectively and reliably handle the weaker label materials referred to above, so that a fully satisfactory production performance may be attained in spite of lower elastic properties of the labelling material. To this purpose, in fact, a very specific degree of vacuum must be provided and maintained throughout operation of the labelling machine.

Also worth considering is the fact that labelling machines typically comprise a plurality of stations at which a vacuum drum or other vacuum-connected surface interacts with the labelling material. More often than not, for the sake of cost limitation and bulk reduction, these machines are generally equipped with a single vacuum source fluidically communicating with each and every vacuum drum through corresponding ducts, the flow along these ducts being alternately enabled and disabled, as a function of a number of processing parameters.

In particular, application (or suspension thereof) of vacuum to a portion of labelling material at a certain time shall depend on the position of the portion with respect to the overall labelling process (i.e. depending on which vacuum drum or surface in the whole of the machine is interacting with the portion of labelling material) and, even more particularly, on the angular position reached by the portion of labelling material upon rotation of a certain vacuum drum, so as to e.g. time the detachment of the label at a given station with the arrival of a container to be labelled at the very same station, and so forth.

To further complicate the picture, vacuum drums are often partitioned, i.e. a number of cavities are defined on their inside, each of which is independently connectable fluidically with the vacuum source, so that a single vacuum drum may be used for independently holding and handling several labels at a time, e.g. one for each separate internal cavity. In this case, the vacuum drum shall be designed so as to allow for alternate opening/interrupting of the fluidic connection of each internal cavity with the vacuum source, so that the supply of vacuum to each partition of the drum is timed with the intended interaction with the labels.

Start-up and shut-down represent particularly critical process phases, since, at those times, i.e. when the very first labels or the very last labels go round the system, a significant percentage of the holes in the vacuum drum are not covered by any labelling material, so a great amount of vacuum source power is potentially wasted.

U.S. Pat. No. 6,546,958 discloses a fixed vacuum plate assembly with a plurality of cavities for providing different levels of vacuum to a rotating vacuum drum in a container labelling apparatus, wherein thin and stretchable films can be swiftly and accurately applied with limited wastage and reduced occurrence of over-tensioning label material during the labelling process. In particular, the different cavities in the plate assembly are configured to be supplied with different levels of vacuum, each of which is suitable for a specific operation involving the label material (e.g. picking a label segment which has just been cut, gripping a label segment while an adhesive is applied to its surface, etc.). By improving the seal between the fixed valve plate and the rotating vacuum drum at the point of high vacuum, vacuum loss is reduced, thereby providing a more precise control of the vacuum at the point of adhesive application and eliminating the spread of high vacuum to adjacent ports that can negatively affect the label cutting and application by changing the vacuum level in these adjacent ports and chambers on a random basis.

However, this type of solution is based on a specific design of the vacuum drum and is therefore lacking in terms of versatility, because, for the whole labelling machine to adjust to different production requirements, the vacuum drums would have to be redesigned accordingly.

The need is therefore felt, in the art, for a container-processing machine of the type where suction is used for handling a sheet-like material—and even more particularly a weak label material—which machine enables selective and accurate control of the amount of vacuum supplied to each and every vacuum drum of a plurality of vacuum drums. In particular, a container-processing machine is needed that shall allow to calibrate, at any time, the amount of vacuum supplied to each vacuum drum in view of the current processing stage and of design parameters (e.g., in the case of a labelling machine, number of labels borne by each drum, operational speed, thickness, elastic properties and dimensions of the label material in use, etc.). Even more so, it is desirable that performance of the container-processing machine be adjustable to varying design parameters (e.g. when different vacuum drums with different characteristics are used with the same vacuum source and control system) in a straightforward and effective manner.

SUMMARY

Examples provide a container-processing machine designed to provide a cheap, convenient solution to the above drawbacks typically associated with known container-processing machines, ensuring a satisfactory accuracy of vacuum level control even when processing particularly thin materials.

According to the present subject matter, there is provided a container-processing machine as set forth in claim 1.

BRIEF DESCRIPTION OF THE DRAWING

In the following, a preferred, non-limiting embodiment of the present invention will be described by way of example with reference to the accompanying drawings, wherein FIG. 1 shows a schematic view of a container-processing machine in accordance with the teachings of the present subject matter.

DETAILED DESCRIPTION

Number 1 in FIG. 1 indicates as a whole a container-processing machine. For the sake of convenience, particular reference shall be made, in the following description, to a labelling machine wherein a sheet-like label material is handled through suction, although this is in no way intended to limit the scope of protection as defined by the accompanying claims.

The container-processing machine 1 comprises a vacuum source 2 which is fluidically connectable with a material handling surface 3. More specifically, the material handling surface 3 is defined by the lateral surface 4 of a vacuum drum 5 of the type commonly used in labelling machines.

As depicted in broad outline in FIG. 1, a vacuum drum 5 typically comprises peripherally a lateral surface 4 for engaging with a label sheet-like material. To this purpose, the lateral surface 4 comprises at least a section having a plurality of through holes 6 in communication with at least an internal passage 7. This passage 7 can be connected to the vacuum source 2 by means of suitable orifices or manifolds, depending on the specific design of the vacuum drum 4. Generally speaking, when vacuum drum 5 reaches, upon rotation about an axis, one or more pre-determined positions where the internal passage 7 is in alignment with the orifices or manifolds, suction shall be applied on the lateral surface 4 of the first section, thereby enabling hold of the label sheet-like material thereat.

In the case depicted in FIG. 1, the vacuum source 2 comprises a vacuum turbine having an inlet duct 8 and outlet duct 9. The inlet duct 8 is in communication with an air inlet 10 through which air is sucked in, whereas the outlet duct 9 is open to the environment for venting.

Preferably, the air inlet 10 is equipped with a filter 11 for preventing particulate material to be sucked in and potentially foul or clog the blades and gears of the vacuum turbine and of the whole system.

Furthermore, the vacuum supply apparatus 1 typically comprises a safety valve 12 arranged between the air inlet 10 and the inlet duct 8 of the vacuum turbine. The setting of the safety valve 12 basically sets the maximum degree of vacuum (the sub-atmospheric pressure) within the whole of the machine 1. The provision of safety valve 12 is mainly intended for protection of the vacuum source 2, hence said valve 12 is typically designed to open when a set pressure value is exceeded.

For fluidic connection between the vacuum source 2 and the material handling surface 3, the container-processing machine 1 comprises a pipeline 13. Where a same vacuum source 2 is used for supplying suction to a plurality of material handling surfaces 3, corresponding pipelines 12 branch off a common manifold 14, as depicted in FIG. 1.

Along the pipeline 12, the vacuum supply apparatus 1 further comprises, along the direction of fluidic flow, a debris interceptor 15 and a filter 16.

In particular, the debris interceptor 15 may consist of a cyclone-type dust separator.

Advantageously, the container-processing machine 1 comprises means 17 for detecting and transmitting a value of pressure of the air being suctioned at a position along the pipeline 13, between the material handling surface 3 and the vacuum source 2. In the embodiment depicted in FIG. 1 the detection and transmission means 17 are located substantially at the debris interceptor 15 with which they are fluidically connected by a sampling duct 18, so that the value of pressure is detected as close as possible to the material handling surface 4 whilst preserving, at once, the means 17 from most potential interferences with particulate material, dust, debris and the like. These means 17 may comprise a pressure transducer.

Advantageously, the container-processing machine 1 further comprises a controllably operable flow valve 19, which is preferably a throttle valve, arranged along the pipeline 13, upstream from the common manifold 14 (if present) and, however, upstream of both the vacuum source 2 and the safety valve 12.

More preferably, the valve 19 is arranged slightly downstream from the filter.

Furthermore, the container-processing machine 1 advantageously comprises a control unit 20 operatively connected with the detection and transmission means 16 and with the flow valve 19. Preferably, the control unit 20 is also operatively connected with a human-machine interface 21.

The control unit 20 is programmed to manage operation of the vacuum supply apparatus 1 as shall be described in the following.

In particular, the control unit 20 is programmed to receive the values of pressure measured by the means 17, and to conveniently adjust the degree of opening of the flow valve 19 in response to a signal which is a function of at least the values of pressure detected.

Preferably, the control unit 20 adjusts the degree of opening of the flow valve 19 so that the pressure in the sampling duct 18 and, consequently, at the material handling surface 3 is maintained at a pre-determined value, which is chosen depending on the properties of the labelling material being handled (e.g. thickness, elastic properties, friction) as well as of the label format. Said pre-determined value shall typically be set by the user through the human-machine interface 21.

As a further alternative, operation of the control unit may basically be timed with the operational speed of the container-processing machine 1 as a whole, so that the degree of vacuum supplied at the material handling unit 3 is always conveniently timed with the specific operation that the operational cycle prescribes.

Depending on the type of pre-programming, the control unit 20 can ensure that the entity of suction provided at the material handling surface 3 is compatible with the operation being carried out thereat at all times. In particular, account may conveniently be taken of particularly delicate phases of a labelling process, such as the cut-and-transfer and pre-glue sections.

It must be noted that, when a label has not yet been cut off the label material web, the material handling surface beneath the label moves at a relatively greater speed, hence the label is practically sliding. After being cut, instead, the label shall move on at the same speed as its supporting surface. As a consequence, the cut-and-transfer phase requires a very accurate calibration of the degree of vacuum supplied for proper handling of the labelling material.

Even more particularly, the pre-determined pressure value which the control unit 20 is programmed to maintain at all times may advantageously be chosen with a view to ensuring consistent conditions for the very first and the very last labels going round the system, i.e. during the start-up and shut-down, which are the most critical operational phases for the vacuum source, since, at those times, a significant percentage of the holes 6 in the material handling surface 4 is not covered by any labelling material.

For example, at start-up, fluidic connection between each section of the vacuum drum respectively handling a label and the vacuum source 2 is sequentially enabled (e.g. by opening corresponding valves) a fraction of a second prior to the arrival of the label at the corresponding section of the material handling surface 4. The control unit 20 is programmed to maintain the pressure (i.e. the degree of vacuum) at said predetermined value, and the corresponding correct suction is thus applied to each of the first labels going round the system. Thus, the vacuum source (turbine) 2 is conveniently required to supply just the most appropriate degree of vacuum only at the sections of material handling surface 4 actually engaging labelling material, hence there is virtually no waste of vacuum source (turbine) power.

To this purpose, the unit control 20 may advantageously comprise a processor 22 and an actuator 23 (e.g. a stepper motor). Within processor 21 suitable elaboration of the pressure data obtained from the means 17 is carried out, so as to obtain a command signal. The unit control 20 supplies this command signal to the actuator 23, which directly varies, accordingly, the degree of opening of flow valve 19.

In use, the control unit 20 shall receive from the detection and transmission means 17 values of pressure of the fluid being suctioned at a position representative of the degree of vacuum provided at the material handling surface 3 and, optionally, information regarding the operation currently being performed at the material handling surface 3 on the portion of sheet-like material being handled. Based on said values and on said information, the control unit 20 shall accordingly adjust the degree of opening of the valve 19, so that the pressure (i.e. the degree of vacuum) at the material handling surface 3 is maintained within a desired operational range.

The advantages of the container-processing machine 1 according to the present subject matter will be apparent from the above description.

In particular, the container-processing machine 1 may provide for selective and accurate control of the degree of vacuum provided at each and every vacuum drum of a plurality of vacuum drums in the machine 1. In particular, with the container-processing machine of the subject matter, constant and appropriate calibration of the degree of vacuum provided at each vacuum drum, in view of the current processing stage and of design parameters, is enabled.

At the same time, as a result of the accurate vacuum control described above, it becomes possible to make use of a smaller and less energy-consuming vacuum source 2: since suction is exploited more sensibly and with constant reference to what operation is being performed at the material handling surface 3, i.e. to the degree of vacuum instantly and actually needed for operational purposes, wastage of vacuum may be reduced, hence the workload forced on the vacuum source may be correspondingly decreased.

In this respect, the container-processing machine of the subject matter is particularly advantageous because it may help reducing both the expense for manufacture of the machine and prime costs, as far as the power consumed by the vacuum source is concerned.

Finally, it shall appear that changes may be made to the container-processing machine as described and illustrated herein without, however, departing from the scope of protection as defined in the accompanying claims.

The invention claimed is:

1. A container processing machine comprising:

a material handling surface to handle a sheet-type material through suction;

a vacuum source in fluid connection with said material handling surface;

means for detecting and transmitting a value of pressure of the gas being suctioned;

a controllably operable flow valve;

a control unit operatively connected with said detection and transmission means and with said flow valve, wherein said detection and transmission means and said flow valve are arranged between said vacuum source and said material handling surface; and debris intercepting means arranged downstream from said material handling surface, said detecting and transmission means being located substantially at said debris interceptor with which they are fluidically connected by a sampling duct;

said control unit being programmed to adjust the degree of opening of said flow valve in response to a signal which is a function of at least said value of pressure.

2. The container processing machine according to claim 1, wherein said flow valve is arranged between said vacuum source and said detection and transmission means.

3. The container processing machine according to claim 1, wherein said control unit comprises a processor and actuating means, the processor elaborating a command signal at least based on the value of pressure obtained from said detection and transmission means, said command signal being supplied to the actuating means to vary accordingly the degree of opening of said flow valve.

4. The container processing machine according to claim 1, wherein said control unit is operatively connected to a human-machine interface and is programmed to adjust the degree of opening of said flow valve in response to a signal which is also a function of information selectively provided by a user.

5. The container processing machine according to claim 1, wherein the means for detecting and transmitting a value of pressure of the gas being suctioned include a transducer.

6. The container processing machine according to claim 5, wherein the transducer is a pressure transducer.

7. The container processing machine according to claim 1, comprising dust separator arranged downstream from said material handling surface, said transducer being located substantially at said debris interceptor with which they are fluidically connected by a sampling duct.

8. The container processing machine according to claim 7, wherein the dust separator includes a cyclone-type dust separator.

9. The container processing machine according to claim 1, wherein said control unit comprises a stepper motor, the processor elaborating a command signal at least based on the value of pressure obtained from said transducer, said command signal being supplied to the motor to vary accordingly the degree of opening of said flow valve.

10. A container processing machine comprising:

a material handling surface to handle a sheet-type material through suction;

a vacuum source in fluid connection with said material handling surface, a pressure transducer to detect and transmit a value of pressure of the gas being suctioned;

a controllably operable flow valve;

a control unit operatively connected with said transducer and with said flow valve, wherein said transducer and said flow valve are arranged between said vacuum source and said material handling surface;

said control unit being programmed to adjust the degree of opening of said flow valve in response to a signal which is a function of at least said value of pressure.

11. The container processing machine according to claim 10, wherein the transducer is a pressure transducer.

12. The container processing machine according to claim 10, wherein said flow valve is arranged between said vacuum source and said transducer.

13. The container processing machine according to claim 10, comprising debris intercepting means arranged downstream from said material handling surface, said transducer being located substantially at said debris interceptor with which they are fluidically connected by a sampling duct.

14. The container processing machine according to claim 10, comprising dust separator arranged downstream from said material handling surface, said transducer being located substantially at said debris interceptor with which they are fluidically connected by a sampling duct.

15. The container processing machine according to claim 14, wherein the dust separator includes a cyclone-type dust separator.

16. The container processing machine according to claim 10, wherein said control unit comprises a processor and actuating means, the processor elaborating a command signal at least based on the value of pressure obtained from said transducer, said command signal being supplied to the actuating means to vary accordingly the degree of opening of said flow valve.

17. The container processing machine according to claim 10, wherein said control unit comprises a motor, the processor elaborating a command signal at least based on the value of pressure obtained from said transducer, said command signal being supplied to the motor to vary accordingly the degree of opening of said flow valve.

18. The container processing machine according to claim 17, wherein the motor includes a stepper motor.

19. The container processing machine according to claim 1, wherein said control unit is operatively connected to a human-machine interface and is programmed to adjust the degree of opening of said flow valve in response to a signal which is also a function of information selectively provided by a user.

* * * * *